US008607608B2

(12) United States Patent
Shioya et al.

(10) Patent No.: US 8,607,608 B2
(45) Date of Patent: Dec. 17, 2013

(54) BENDING APPARATUS AND BENDING METHOD

(75) Inventors: Susumu Shioya, Mishima (JP); Kouichi Nakamura, Mishima (JP)

(73) Assignee: Seiko Works Ltd., Mishima-shi, Shizuoka (JP)

( * ) Notice: Subject to any disclaimer, the term of this patent is extended or adjusted under 35 U.S.C. 154(b) by 652 days.

(21) Appl. No.: 12/527,294

(22) PCT Filed: Feb. 20, 2007

(86) PCT No.: PCT/JP2007/053022

§ 371 (c)(1),
(2), (4) Date: Aug. 14, 2009

(87) PCT Pub. No.: WO2008/102430

PCT Pub. Date: Aug. 28, 2008

(65) Prior Publication Data

US 2010/0107715 A1 May 6, 2010

(51) Int. Cl.

| | |
|---|---|
| ***B21D 7/04*** | (2006.01) |
| ***B21D 5/14*** | (2006.01) |
| ***B21D 45/00*** | (2006.01) |

(52) U.S. Cl.
USPC ..... 72/149; 72/169; 72/426

(58) Field of Classification Search
USPC ..... 72/149, 154, 217, 307, 372, 381, 382, 72/389.7, 431, 432, 453.01, 166, 169, 250, 72/252, 426, 428
See application file for complete search history.

(56) References Cited

U.S. PATENT DOCUMENTS 5,819,574 A * 10/1998 Yogo ..... 72/149

FOREIGN PATENT DOCUMENTS

| | | |
|---|---|---|
| JP | 56-160608 | 11/1981 |
| JP | S59-202123 A | 11/1984 |
| JP | 2000-117333 | 4/2000 |
| JP | 2002-066642 | 5/2002 |

OTHER PUBLICATIONS

Machine Translation of Tsuchiya et al., JP 2002-066642, pp. 1-16.*

* cited by examiner

*Primary Examiner* — Teresa M Ekiert
(74) *Attorney, Agent, or Firm* — Merchant & Gould P.C.

(57) ABSTRACT

A bending apparatus (1) is for bending a workpiece (object to be worked), using a bending die (2) formed in accordance with a bent form of the workpiece, and a linear die (3) linearly extended, and includes a table (10) having a work face (11*a*) where the bending die (2) and the linear die (3) are placed; and a pair of rollers (40, 50) configured to move along the work face (11*a*), wherein each of the rollers (40, 50) is configured to move from one end side of the bending die (2) and the linear die (3) to the other end side thereof in a state of pinching the bending die (2) and the linear die (3) in a die closing direction. According to this configuration, it is possible to configure the bending apparatus (1), to make a work space small, and to improve the work efficiency of the bending.

2 Claims, 6 Drawing Sheets

BENDING APPARATUS AND BENDING METHOD

This application is a National Stage Application of PCT/JP2007/053022, filed 20 Feb. 2007 and which application is incorporated herein by reference. To the extent appropriate, a claim of priority is made to the above disclosed application.

TECHNICAL FIELD

The present invention relates to a bending apparatus and a bending method for bending a long member.

BACKGROUND ART

In manufacturing a frame member and bumper reinforced member of an automobile, or a member for a construction structure and an exterior, there is a case of performing a bending process of curving a long member such as an aluminum section material and a steel material in a longitudinal direction thereof.

With respect to a bending method of a long member, for example, as described in Japanese Patent Laid-Open Publication No. 2002-066642 (see paragraph 0027 and FIG. 1), there is the bending method of using a bending die curved like an arc in accordance with a bent form of a workpiece (object to be worked) of the long member, and a linear die linearly extended.

As a bending apparatus for performing the bending method, there is one comprising: a table having a work face where a bending die and a linear die are placed; and a pair of rollers provided on the work face, wherein each of the rollers is configured to be driven and rotated at a predetermined position on the work face.

According to the bending method described in the Japanese Patent Laid-Open Publication No. 2002-066642, firstly, frond-end sides of the bending die and the linear die are fitted with each other, and the dies are placed on the work face in a state of their back-end sides being opened. Moreover, a workpiece is attached to a forming face of the linear die, and a front end of the workpiece is held by a front end of a forming face of the bending die.

When the front ends of the bending die and the linear die where the workpiece is set are sent between each of the rollers, the dies pass between each of the rollers from a back to front thereof in a state of being pinched in a die closing direction by each of the rollers.

With respect to the bending die like an arc, because a region having passed between each of the rollers is moved in a direction away from the linear die, the bending die and the linear die result in a state of their front end sides being opened. At this time, because the front end of the workpiece is held on the work face of the bending die, the workpiece is separated from the linear die in a state of being stuck to the forming face of the bending die, and is bent along the forming face of the bending die.

According to the bending method described in the Japanese Patent Laid-Open Publication No. 2002-066642, because a bending stress can be uniformly acted on a workpiece, it is possible to improve a working accuracy. Furthermore, it is possible to speedily adapt various forms of bending.

However, according to the bending method described in the Japanese Patent Laid-Open Publication No. 2002-066642, because the bending die and the linear die move from the back to front of each of the rollers, and it is necessary to ensure a space at the back and front of each of the rollers in order that the dies move, there is a problem that the bending apparatus results in being wholly jumbo sized.

Furthermore, an inertia force acts on the bending die and the linear die after they pass each of the rollers, it is difficult to stop the dies. Furthermore, after the bending, it is necessary to return the bending die and the linear die, which are moved to the front of each of the rollers, to the back of each of the rollers.

Thus, according to the bending method described in the Japanese Patent Laid-Open Publication No. 2002-066642, because a worker needs to handle the bending die and the linear die for every one bending, there is a problem that an operation is troublesome and a work efficiency is reduced.

Particularly, in bending a workpiece whose axial section is large, because axial sections of the bending die and the linear die are large in proportion to a size of the workpiece, and weight of the dies increases, it is difficult for a worker to handle the dies.

DISCLOSURE OF THE INVENTION

In order to address the conventional problems described above, the inventors have developed a research and development, and attained to devise the present invention. That is, one aspect of the invention is to be able to configure a bending apparatus wholly compact, and to provide the bending apparatus and a bending method that can improve a work efficiency.

More specifically, the bending apparatus as the one aspect of the invention is for bending an object to be worked, using a bending die formed in accordance with a bent form of the object, and a linear die linearly extended, and comprises: a table having a work face where the bending die and the linear die are placed; and a pair of rollers moving along the work face, wherein each of the rollers is configured to move from one end sides of the bending die and the linear die to the other end sides thereof in a state of pinching the bending die and the linear die in a die closing direction.

Moreover, the bending method as another aspect of the invention is for bending an object to be worked, using a bending die formed in accordance with a bent form of the object, and a linear die linearly extended, and comprises the steps of: attaching the object to a forming face of the linear die, and holding one end of the object to one end of the forming face; and moving a pair of rollers from one end sides of the dies to the other end sides thereof in a state of pinching the dies in a die closing direction by each of the rollers, and thereby deforming the object along the forming face of the bending die.

According to the configurations thus described, because each of the rollers is moved relative to the bending die and the linear die, and the dies are positioned on the work face of the table, it is sufficient that a space capable of placing the dies is ensured on the work face. That is, it is possible to perform similar bending with a half distance in comparison with a conventional configuration of moving a bending die and a linear die relative to each roller. Accordingly, the invention can configure a bending apparatus compact and make a work space required for bending small.

Furthermore, according to the invention, because bending is performed in a state of the bending die and the linear die being positioned, it is not necessary for a worker to handle the dies for every one bending. Accordingly, even in continuously performing bending and in using a large size of a bending die and a linear die, it is possible to improve the work efficiency of the bending.

The various aspects and effects of the invention, and other effects and further features of the invention will become more apparent by detailed descriptions of exemplary and non limited embodiments of the invention described later with reference to attached drawings.

BRIEF DESCRIPTION OF THE DRAWINGS

FIG. 5A is a perspective view before bending; and FIG. 5B is a perspective view after the bending.

BEST MODE(S) FOR CARRYING OUT THE INVENTION

Next will be described embodiments of the present invention in detail, referring to drawings as needed.

In an embodiment of the invention, as an example, a case is described where a workpiece (object to be worked) of a linear extrusion section material made of aluminum alloy is curved like an arc.

In addition, in descriptions below, forward and backward directions correspond to those shown in FIG. 1. The forward and backward directions are set for convenience in describing a bending apparatus, and do not limit a configuration of the apparatus.

[Configuration of Bending Die and Linear Die]

Firstly will be described a bending die and a linear die used for a bending apparatus and bending method of the embodiment.

Figure 5A:
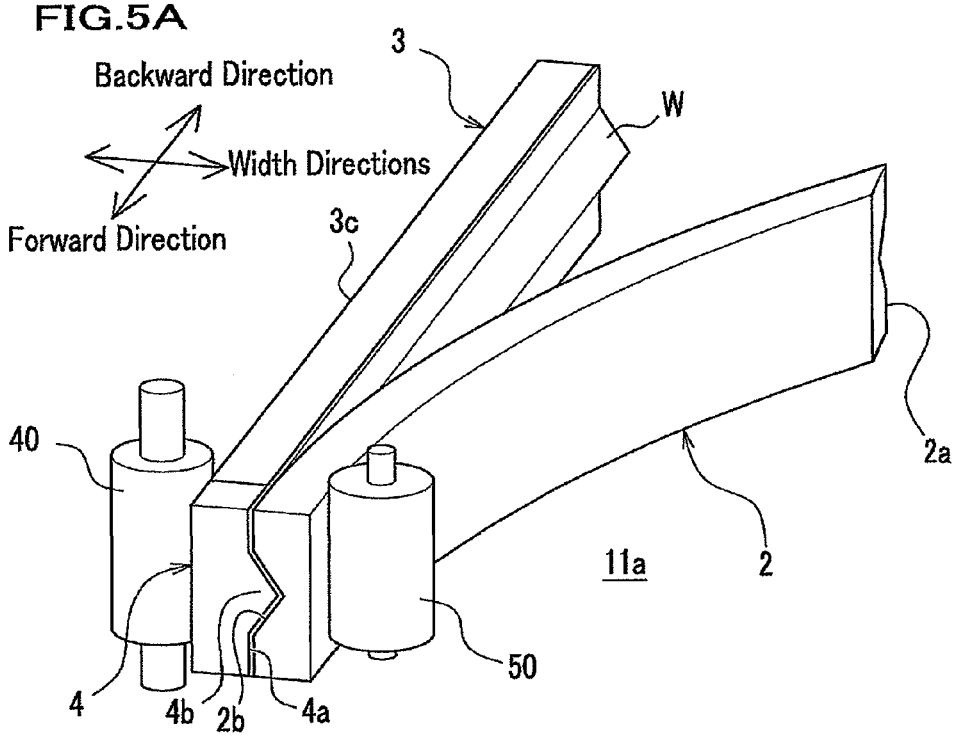
FIGS. 5A and 5B are drawings showing the bending apparatus of the embodiment.

As shown in FIG. 5A, the embodiment is configured to perform bending, using a bending die 2 formed in accordance with a bent form of a workpiece W, and a linear die 3 linearly extended.

In addition, the workpiece W of the embodiment is folded so that a chevron protrusion protruded rightward in FIG. 5A is formed over a whole length in a longitudinal direction.

<Configuration of Bending Die>

The bending die 2 is curved, as shown in FIG. 5A, like an arc in a longitudinal direction in accordance with a bent form of the workpiece W after bending. On a forming face 2*a* (left face in FIG. 5A) of the bending die 2, over a whole length is formed a sectional V-shape fit-in groove 2*b* corresponding to a sectional shape of the workpiece W, and it is possible to attach the workpiece W to the face 2*a* of the die 2.

<Configuration of Linear Die>

Figure 5B:
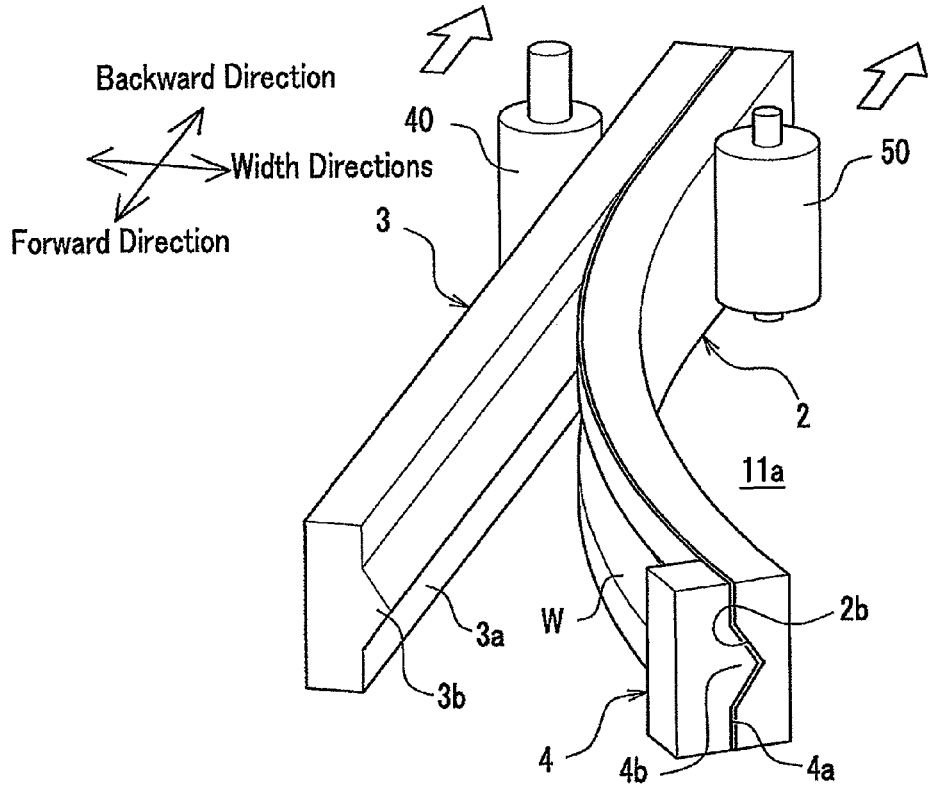

A linear die 3 is linearly extended, as shown in FIG. 5B, in a longitudinal direction in accordance with a form of the workpiece W before bending. On a forming face 3*a* (right face in FIG. 5B) of the linear die 3, over a whole length is formed a protrusion 3*b* corresponding to the sectional shape of the workpiece W, and it is possible to attach the workpiece W to the face 3*a* of the die 3.

<Configuration of Holding Member>

To a front end of the forming face 2*a* of the bending die 2 is attached a holding member 4 with the same sectional shape as the linear die 3. On a forming face 4*a* (right face in FIG. 5A) of the holding member 4 is formed a protrusion 4*b* with the same shape as the protrusion 3*b*.

In addition, in a state of the holding member 4 being attached to a front end of the bending die 2, a gap is formed between the forming face 4*a* of the member 4 and the forming face 2*a* of the die 2, and it is possible to insert a front end of the workpiece W in the gap.

[Configuration of Bending Apparatus]

Next will be described the bending apparatus in detail.

Figure 1:
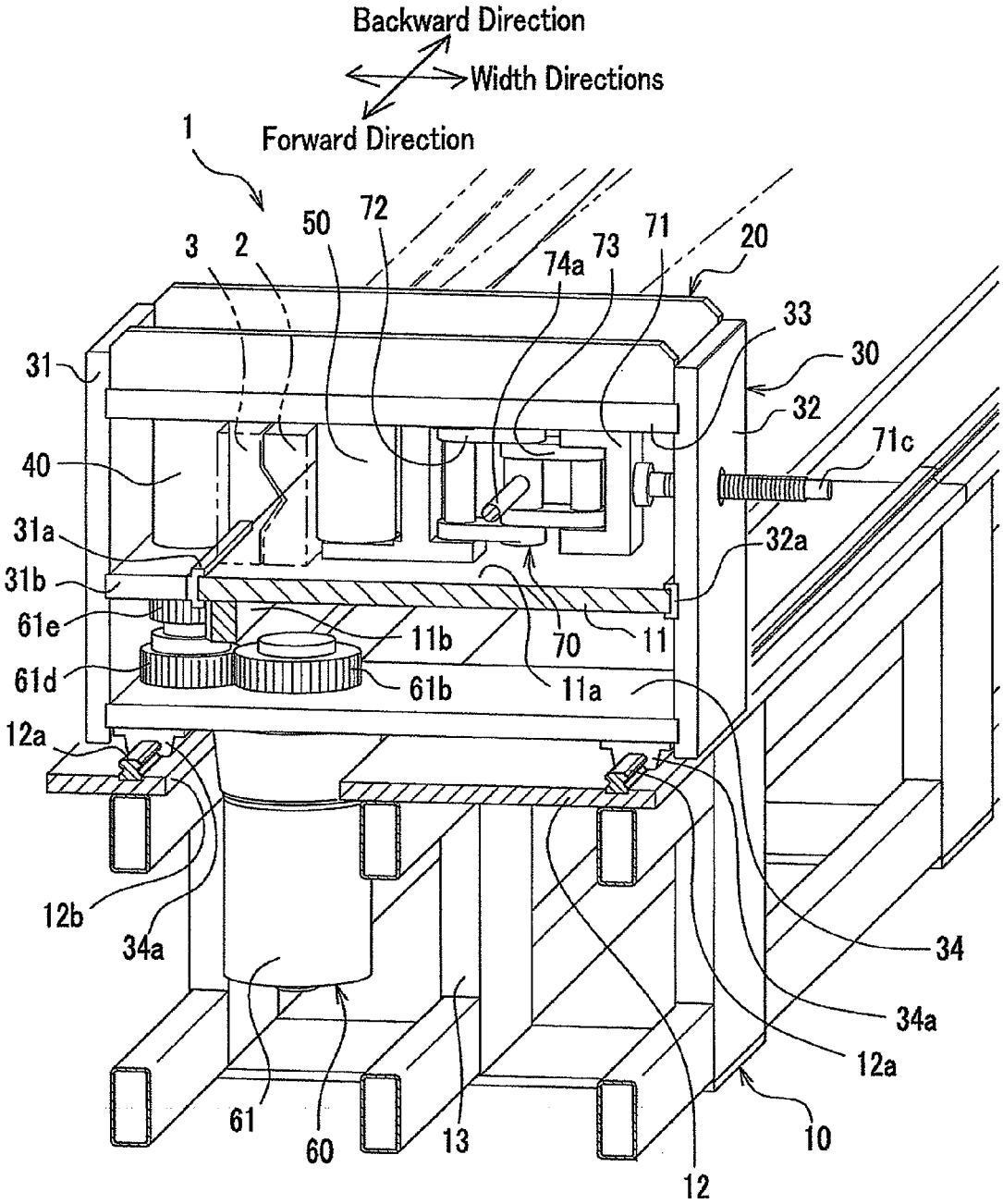
FIG. 1 is a perspective view showing a configuration of a bending apparatus of an embodiment of the present invention.

A bending apparatus 1 comprises, as shown in FIG. 1, a table 10 having a work face 11*a* where the bending die 2 and the linear die 3 are placed, and a slide unit 20 configured to be slid in the forward and backward directions relative to the table 10.

<Configuration of Table>

The table 10 comprises, as shown in FIG. 1, an upper fixation plate 11 and to a lower fixation plate 12 separately arranged with a predetermined distance in an up-and-down direction, and a leg portion 13 configured to support the plates 11 and 12 in a predetermined height.

Figure 2:
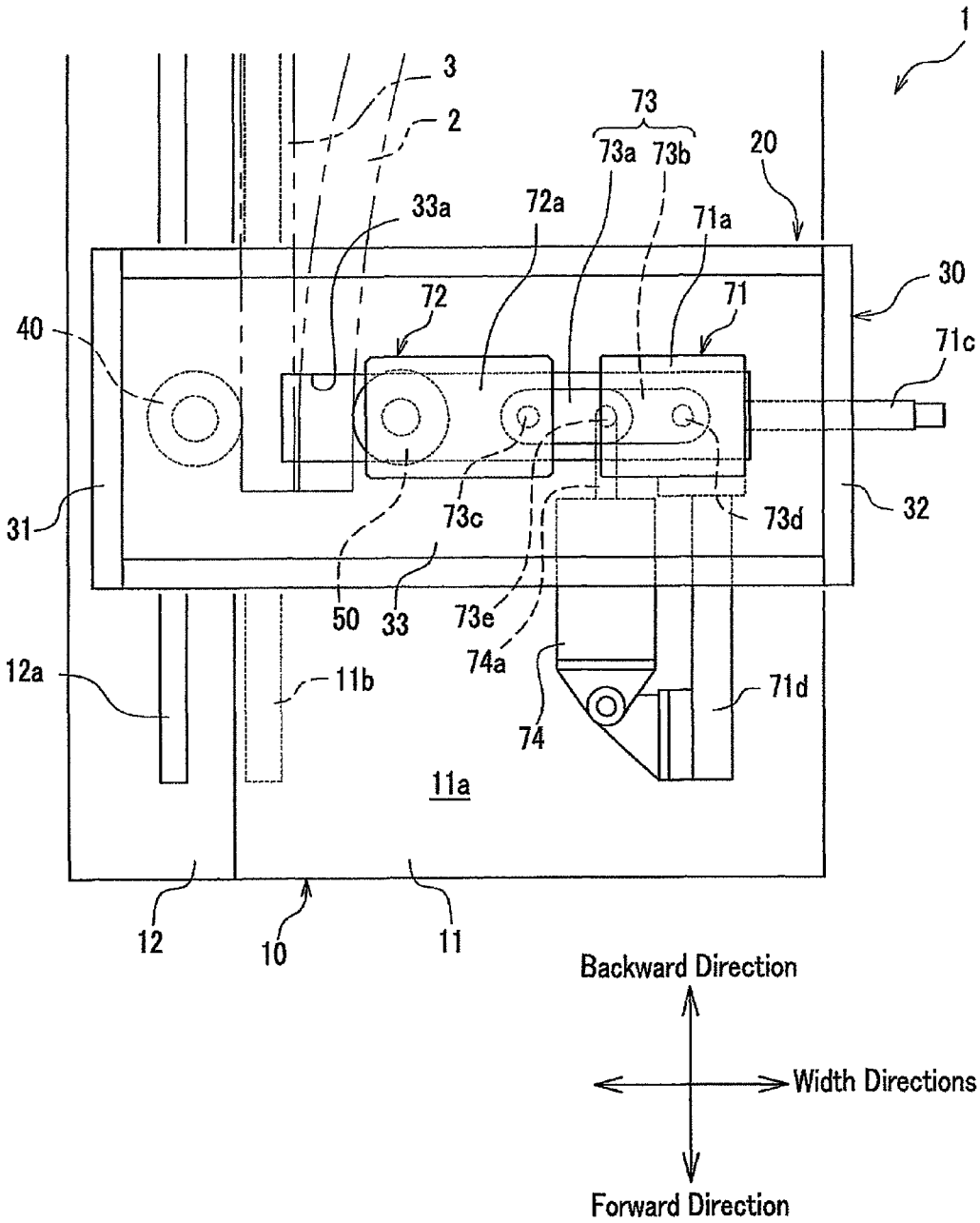
FIG. 2 is a plan view showing a configuration of the bending apparatus of the embodiment.

The upper fixation plate 11 is, as shown in FIG. 2, a rectangular plate-form member in a plan view, and is extended in the forward and backward directions.

An upper face of the upper fixation plate 11 is a horizontal work face where the bending die 2 and the linear die 3 are placed. The bending die 2 and the linear die 3 are placed in a left area of the work face 11*a* in FIG. 2.

Furthermore, with respect to a lower face of the upper fixation plate 11, to a left end thereof in FIG. 2 is attached a rack gear 11*b*. A tooth face of the rack gear 11*b* is formed on a left face thereof in FIG. 2 (see FIG. 3).

The lower fixation plate 12 is, as shown in FIG. 1, arranged below the upper fixation plate 11. The lower fixation plate 12 is a rectangular plate-form member in a plan view, and is extended in the forward and backward directions.

With respect to an upper face of the lower fixation plate 12, to a left end and a right end thereof in FIG. 1 are attached guide rails 12*a*, 12*a* with an I-shape in their axial section. The guide rails 12*a*, 12*a* are extended in the forward and backward directions.

Furthermore, with respect to the lower fixation plate 12, in a left area thereof in FIG. 2, an opening groove 12*b* for inserting therethrough a drive motor 61 described later is extended in the forward and backward directions.

<Configuration of Slide Unit>

The slide unit 20 is, as shown in FIG. 1, a member slidable in the forward and backward directions relative to the upper fixation plate 11, and comprises a frame body 30 rectangular in a front view thereof, a pair of rollers 40, 50 supported within the body 30, a driving device 60 for moving the body 30, and an adjustment mechanism 70 for adjusting a distance between each roller 40, 50.

The frame body 30 comprises, as shown in FIG. 1, side plates 31, 32 vertically provided on both sides of the upper fixation plate 11 in width directions thereof, an upper plate 33 hung across an upper end of each side plate 31, 32, and a lower plate 34 hung across a lower end of each side plate 31, 32.

The upper plate 33 is arranged above the upper fixation plate 11; the lower plate 34 is arranged between the plate 11 and the lower fixation plate 12.

With respect to a lower face of the lower plate 34, two lower sliders 34*a*, 34*a*, are attached, respectively, to positions corresponding to the two guide rails 12*a*, 12*a* provided on the upper face of the lower fixation plate 12.

On a lower face of a lower slider 34*a* is formed a groove portion fitting in an upper portion of a guide rail 12*a*, and the slider 34*a* is freely slidable along the rail 12*a* in the forward and backward directions.

Then each lower slider 34*a*, 34*a* of the lower plate 34 is fitted in each guide rail 12*a*, 12*a* of the lower fixation plate 12, and thereby, the frame body 30 is supported by the table 10 in a state of being freely slidable in the forward and backward directions.

With respect to an inner face of the side plate 31 arranged on a left side in FIG. 1, at a position corresponding to a side end of the upper fixation plate 11 is provided a protrusion 31*b*. To a top end of the protrusion 31*b* is attached a side slider 31*a* having a depression groove fitting in the side end of the upper fixation plate 11.

With respect to an inner face of the side plate 32 arranged on a right side in FIG. 1, at a position corresponding to a side end of the upper fixation plate 11 is attached a side slider 32*a* having a depression groove fitting in the side end of the plate 11.

Each side slider 31*a*, 32*a* is freely slidable in the forward and backward directions, and plays a role of reducing a vibration of the frame body 30 when the body 30 is slid in the forward and backward directions relative to the upper fixation plate 11.

Figure 3:
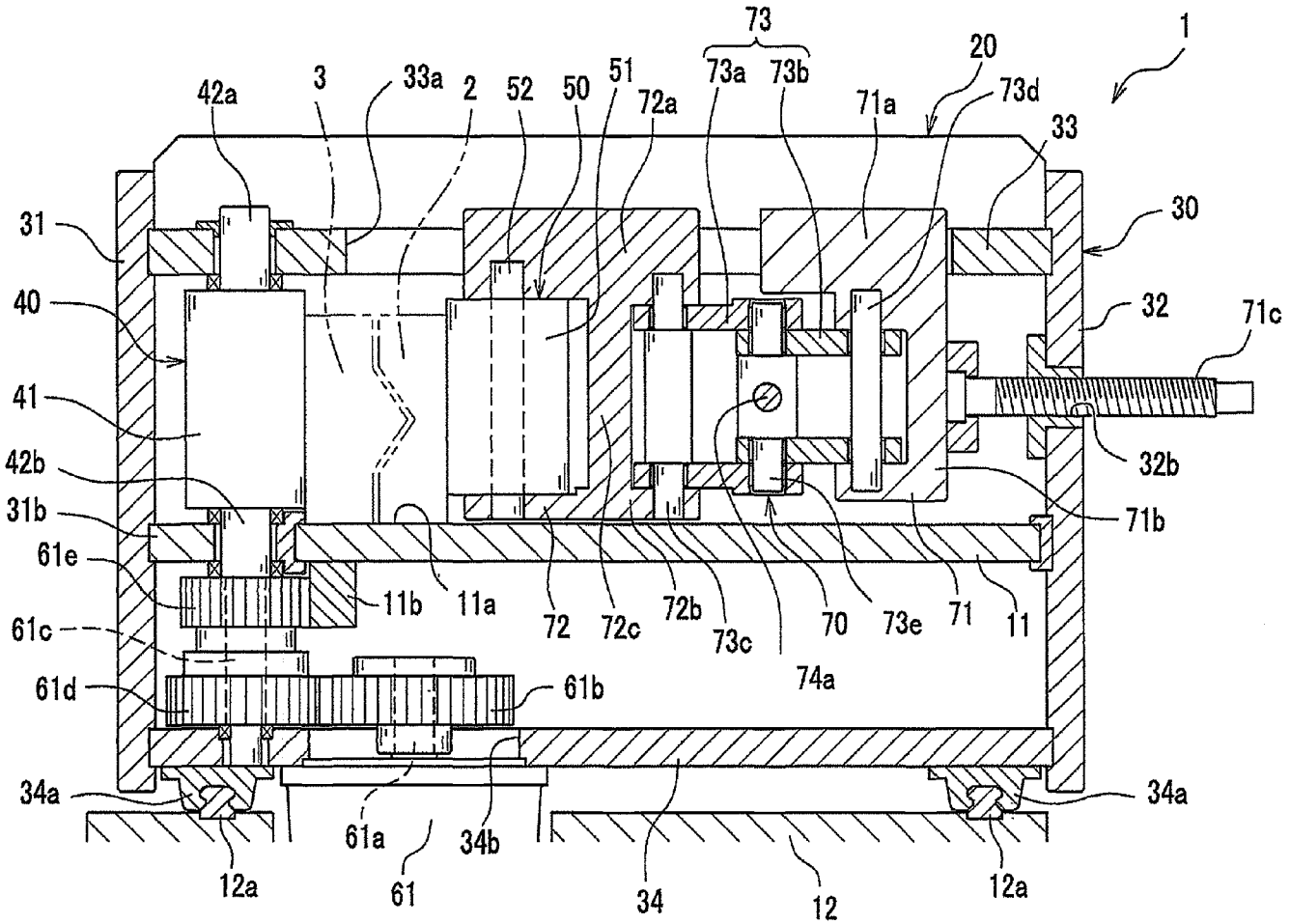
FIG. 3 is a front section view showing a configuration of the bending apparatus of the embodiment.

As shown in FIG. 3, the pair of the rollers 40, 50 have their peripheral faces around their vertical axes, and are supported within the frame body 30 between the upper plate 33 and the upper fixation plate 11. Accordingly, when the frame body 30 is slid in the forward and backward directions relative to the table 10, the each roller 40, 50 is moved in the forward and backward directions above the forming face 11*a* of the upper fixation plate 11.

The first roller 40 arranged on a left side in FIG. 3 comprises a columnar roller body 41, and support shafts 42*a*, 42*b* protruded up and down from a shaft center of the body 41.

An upper end of the upper support shaft 42*a* is supported in a through hole formed in the upper plate 33 in a state of being freely rotatable; a lower end of the lower support shaft 42*b* is supported in a through hole formed in the protrusion 31*b* of the side plate 31 in a state of being freely rotatable.

The second roller 50 arranged on a right side in FIG. 3 comprises a cylindrical roller body 51, and a support shaft 52 penetrating a shaft center of the body 51.

Upper and lower ends of the support shaft 52 are fixed to a roller support portion 72 of the adjustment mechanism 70 described later, and the roller body 51 is freely rotatable around the support shaft 52.

The driving device 60 shown in FIG. 1 is a device for moving the slide unit 20 in the forward and backward directions relative to the table 10, and comprises an electric type of the drive motor 61 attached to a lower face of the lower plate 34 of the frame body 30.

With respect to the drive motor 61, an upper end face thereof is fixed to the lower face of the lower plate 34, and the motor 61 is inserted through the opening groove 12*b* formed in the lower fixation plate 12 of the table 10.

Furthermore, with respect to the drive motor 61, an output shaft 61*a* is protruded upward from the upper end face of the motor 61. The output shaft 61*a* is inserted through an opening 34*b* formed in the lower plate 34 and is protruded to an upper face side of the plate 34. Moreover, to an upper end of the output shaft 61*a* is fixed an output gear 61*b* of a spur gear.

Furthermore, on a left side of the output gear 61*b* in FIG. 3 is provided a rotation shaft 61*c* whose shaft direction is directed in a vertical direction. A lower end of the rotation shaft 61*c* is supported in a through hole formed in the lower plate 34 of the frame body 30 in a state of being freely rotatable.

Furthermore, to a lower portion of the rotation shaft 61*c* is fixed a reduction gear 61*d* of a spur gear. The reduction gear 61*d* is engaged with the output gear 61*b*, and the rotation shaft 61*c* is configured to rotate in conjunction with a rotation of the output shaft 61*a*.

In addition, a tooth number of the reduction gear 61*d* is set relative to that of the output gear 61*b* so that a rotation speed of the rotation shaft 61*c* is reduced more than that of the output shaft 61*a*.

Furthermore, to an upper portion of the rotation shaft 61*c* is fixed a pinion gear 61*e* of a spur gear. The pinion gear 61*e* is engaged with the rack gear 11*b* attached to the lower face of the upper fixation plate 11, and the gear 61*e* is configured to roll on the tooth face of the rack gear 11*b* in the forward and backward directions.

Furthermore, an upper end of the rotation shaft 61*c* is connected to a lower portion of the lower support shaft 42*b* of the first roller 40. Accordingly, the first roller 40 is connected to the rotation shaft 61*a* through the rotation shaft 61*c*, the reduction gear 61*d*, and the output gear 61*b*.

When the drive motor 61 is activated and the rotation shaft 61*a* is rotated, a rotational driving force is transmitted to the pinion gear 61*e* through the output gear 61*b*, the reduction gear 61*d*, and the rotation shaft 61*c*, and the gear 61*e* rolls on the tooth face of the rack gear 11*b* in the forward and backward directions.

Because the rotation shaft 61*c* where the pinion gear 61*e* is fixed is supported by the frame body 30, the body 30 is moved along each guide rail 12*a*, 12*a* in the forward and backward directions in conjunction with the gear 61*e* moving in the directions.

Furthermore, because the pinion gear 61*e* and the first roller 40 are connected through the rotation shaft 61*c*, the gear 61*e* and the roller synchronously rotate.

According to the bending apparatus 1 of the embodiment, a position detection sensor (not shown) for detecting a position of the slide unit 20 is attached to each portion of the table 10.

When the slide unit 20 is moved backward from a front portion of the upper fixation plate 11 and reaches a predetermined position, the unit 20 is detected by a position detection sensor at a back portion of the table 10, and the output shaft 61*a* of the drive motor 61 is reversely rotated, based on a signal from the sensor.

Furthermore, by the output shaft 61*a* being reversely rotated, when the slide unit 20 is moved forward and returns to a reference position, it is configured that the unit 20 is detected by a position detection sensor at a front of the table 10, the output shaft 61*a* of the drive motor 61 is stopped, based on a detection signal from the sensor, and the unit 20 stops.

<Configuration of Adjustment Mechanism>

The adjustment mechanism 70 comprises: a base portion 71 connected to the side plate 32 provided on a right side in FIG. 3; a roller support portion 72 for supporting the second roller 50; a connection link 73 for connecting the support portion 72 and the base portion 71; and a hydraulic cylinder 74 connected to the link 73.

In the base portion 71 are formed an upper portion 71*a* of a cuboid and a side portion 71*b* protruded downward from the portion 71*a*.

The upper portion 71*a* of the base portion 71 is inserted through a guide groove 33*a* formed in the upper plate 33 of the frame body 30, a flange portion formed on an upper end of the portion 71*a* is hooked at an edge of the groove 33*a*, and thereby, the portion 71 is hung down from the plate 33 (see FIG. 2).

In addition, as shown in FIG. 2, because the guide groove 33*a* of the upper plate 33 is extended in the width directions, it is possible for the base portion 71 to move along the groove 33*a* in the width directions.

To the side portion 71*b* of the base portion 71 is attached, as shown in FIG. 3, a base portion of a bolt member 71*c* in a state of being freely rotatable.

A top end of the bolt member 71*c* is screwed in a screw hole 32*b* formed in the side plate 32 provided on a right side in FIG. 3, and is protruded outside.

When moving the base portion 71 in the width directions, a worker rotates the bolt member 71*c*, moves it in the width directions relative to the side plate 32, and thereby, it is possible to move in the width directions the portion 71 connected to the base end of the member 71*c*.

Furthermore, as shown in FIG. 2, to a front face of the base portion 71 is attached an attachment bracket 71*d* protruded forward. The attachment bracket 71*d* is a member for supporting the hydraulic cylinder 74 described later.

In the roller support portion 72 are formed, as shown in FIG. 3, an upper portion 72*a* and lower portion 72*b* of a cuboid, and an intermediate portion 72*c* for connecting the portions 72*a* and 72*b*.

The roller support portion 72 is arranged on a left side relative to the base portion 71 in FIG. 3, and pinches the second roller 50 from up and down by the upper portion 72*a* and the lower portion 72*b*.

An upper end of the support shaft 52 of the second roller 50 is fixed to the upper portion 72*a*; a lower end of the shaft 52 is fixed to the lower portion 72*b*.

The upper portion 72*a* of the support shaft 52 is inserted through the guide groove 33*a* formed in the upper plate 33 of the frame body 30, a flange portion formed in an upper end of the portion 72*a* is hooked at an edge of the groove 33*a* formed in the plate 33, and thereby, the roller support portion 72 is hung from the plate 33 (see FIG. 2). Accordingly, it is possible for the roller support portion 72, same as the base portion 71, to move along the guide groove 33*a* in the width directions.

The connection link 73 is a toggle link having link members 73*a*, 73*b* connected in the width directions.

One end (left end in FIG. 3) of the first link member 73*a* arranged on a left side in FIG. 3 is pivotally supported at the roller support portion 72 by a pin 73*c*, and the member 73*a* is freely turnable in the horizontal direction relative to the portion 72.

One end (right end in FIG. 3) of the second link member 73*b* arranged on a right side in FIG. 3 is pivotally supported at the base portion 71 by a pin 73*d*, and the member 73*b* is freely turnable in the horizontal direction relative to the portion 71.

The other end of the first link member 73*a* (right end in FIG. 3) and the other end (left end in FIG. 3) of the second link member 73*b* are connected by a pin 73*e*; the member 73*a* and the member 73*b* are configured to open and close in the width directions, making the pin 73*e* a turnable center.

As shown in FIG. 2, a base end of the hydraulic cylinder 74 is pivotally supported at a front end of the attachment bracket 71*d* attached to a front face of the base portion 71, and the cylinder 74 is capable of being freely oscillated in the horizontal direction.

A top end of a rod 74*a* protruded from the hydraulic cylinder 74 is attached to the pin 73*e* of the connection link 73.

When the rod 74*a* is extended from the hydraulic cylinder 74 (state in FIG. 2), the pin 73*e* of the connection link 73 is extruded forward, and each link member 73*a*, 73*b* is in a state of being opened.

Figure 4:
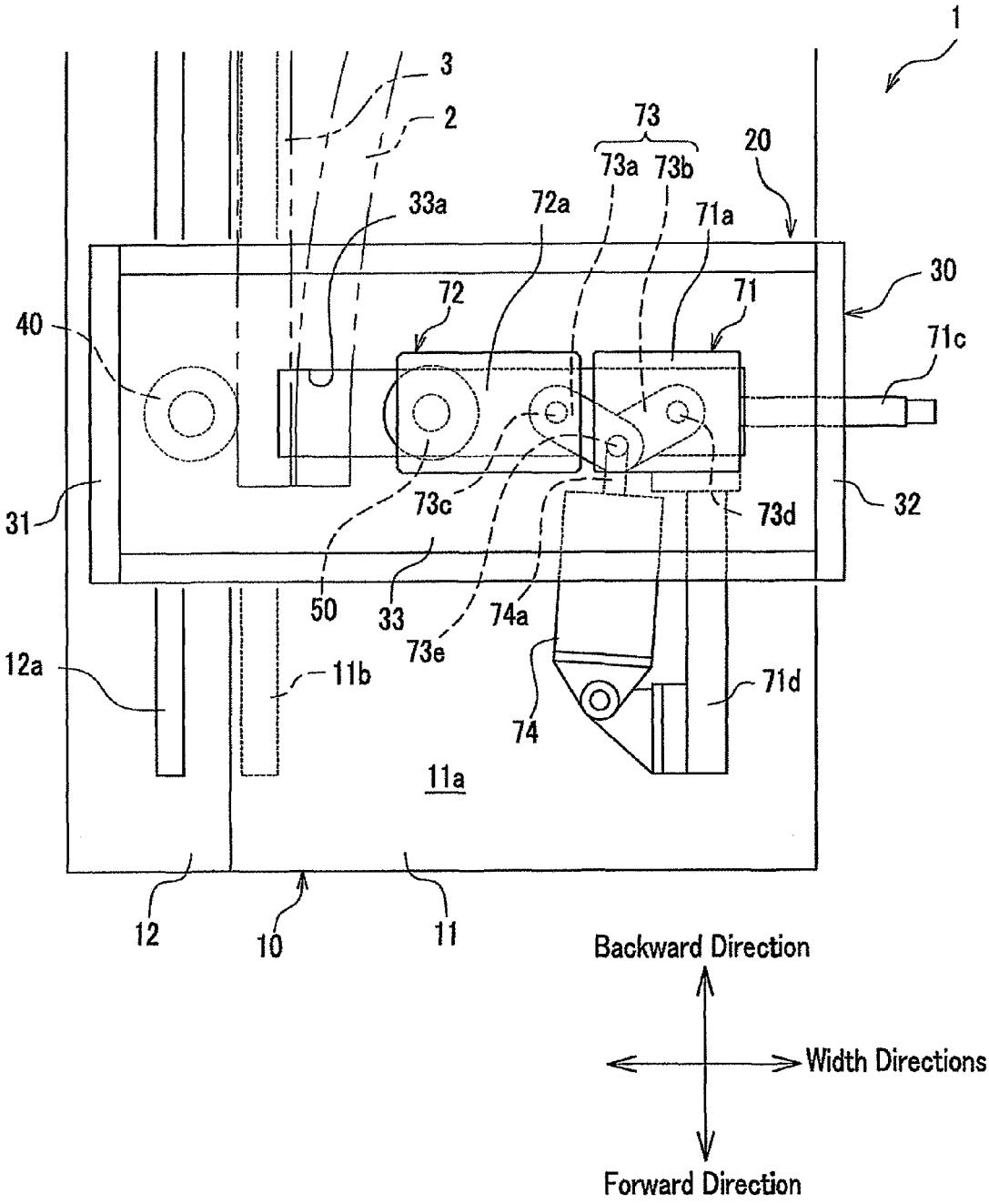
FIG. 4 is a plan view showing a state of each link member of an adjustment mechanism being closed in the bending apparatus of the embodiment.

Furthermore, as shown in FIG. 4, the rod 74*a* is retracted into the hydraulic cylinder 74, the pin 73*e* of the connection link 73 is drawn to a cylinder 74 side (front), and each link member 73*a*, 73*b* is in a state of being closed.

In addition, because the base portion 71 is positioned by the bolt member 71*c*, as shown in FIG. 2, when each link member 73*a*, 73*b* is opened, the first link member 73*a* is extruded leftward in FIG. 2.

According to this, because the roller support portion 72 connected to the first link member 73*a* is moved leftward in FIG. 2, and the second roller 50 supported at the portion 72 is moved leftward in FIG. 2, a distance between the each roller 40, 50 is narrowed.

Furthermore, when the distance between the each roller 40, 50 is broadened, each link member 73*a*, 73*b* is closed as shown in FIG. 4, thereby, the roller support portion 72 is moved rightward in FIG. 4, and the second roller 50 is moved rightward in FIG. 4; therefore, it is possible to broaden the distance between the each roller 40, 50.

According to the bending apparatus 1 of the invention, an proximity sensor (not shown) is attached to the hold member 4 of the bending die 2 shown in FIG. 5A, and it is configured that when the workpiece W is inserted in a gap between the member 4 and the die 2, the sensor detects the workpiece W.

Then, it is configured that when the workpiece W is detected by the proximity sensor, the rod 74*a* of the hydraulic cylinder 74 shown in FIG. 2 is extended to a predetermined length. Moreover, it is configured that when the hydraulic cylinder 74 is extended to the predetermined length, the drive motor 61 shown in FIG. 3 is activated and the output shaft 61*a* is rotated.

[Bending Method]

Next will be described the bending method using the bending apparatus 1 of the embodiment.

Firstly, as shown in FIG. 1, the bending die 2 and the linear die 3 are placed on the work face 11*a* of the upper fixation plate 11. Specifically, as shown in FIG. 5A, a front end of the linear die 3 whose longitudinal direction is directed in the forward and backward directions is arranged between the each roller 40, 50, and the die 3 is fixed on the work face 11*a* by a fixation means such as a bolt in a state of the outer face 3*c* (left face in FIG. 3) of the die 3 being contacted with a peripheral face of the first roller 40.

Furthermore, the hold member 4 is attached to the front end of the bending die 2, and the die 2 is placed on the forming face 11*a* so that the forming face 2*a* (left face in FIG. 1) of the die 2 is faced off against the forming face 3*a* (right face in FIG. 1). Moreover, the front end of the bending die 2 is protruded forward from between the each roller 40, 50, and the hold member 4 is faced off against the front end face of the linear die 3.

According to this, the bending die 2 and the linear die 3 are placed on the work face 11*a* in a state of their front end sides being closed and their back end sides being opened. At this time, the bending die 2 is capable of being oscillated in the horizontal direction relative to the linear die 3 fixed on the work face 11*a*.

Subsequently, the workpiece W is attached to the forming face 3*a* of the linear die 3. Moreover, the front end of the workpiece W is inserted in a gap between the bending die 2 and the hold member 4, and is held by the front end of the forming face 2*a*.

When the workpiece W is inserted in the gap between the bending die 2 and the hold member 4, the proximity sensor (not shown) detects the workpiece W, and as shown in FIG. 2, the rod 74*a* of the hydraulic cylinder 74 is extended to a predetermined length.

The pin 73*e* of the connection link 73 is extruded backward by the extended rod 74*a*, the each link member 73*a*, 73*b* is opened in the width directions; thereby, the second roller 50 is moved leftward in FIG. 2, and a distance between the each roller 40, 50 is narrowed. According to this, the bending die 2 and the linear die 3 is in a state of being pinched by the each roller 40, 50 with a predetermined pushing force in a die closing direction (see FIG. 5A).

In addition, even in a state of the each link member 73*a*, 74*a* being opened to a maximum extent, when a sufficient pushing force does not act on the bending die 2 and the linear die 3 from the each roller 40, 50, a worker rotates the bolt member 71*c* shown in FIG. 3 and moves the base portion 71 leftward in FIG. 3. According to this, because the each link member 73*a*, 73*b* is moved leftward in FIG. 3, that is, to a first roller 40 side, it is possible to act a sufficient force on the bending die 2 and the linear die 3 from the each roller 40, 50 in opening the each link member 73*a*, 73*b*.

Furthermore, when the rod 74*a* of the hydraulic cylinder 74 is extended to a predetermined length, the drive motor 61 is activated and the rotation shaft 61*a* is rotated. The rotation driving force of the rotation shaft 61*a* is transmitted to the pinion gear 61*e* through the output gear 61*b*, the reduction gear 61*d*, and the rotation shaft 61*c*, the gear 61*e* rolls backward on the rack gear 11*b*, and thereby, the slide unit 20 is moved backward.

The each roller 40, 50 in the slide unit 20 is moved, as shown in FIG. 5B, backward along the work face 11*a* of the upper fixation plate 11, and is moved from the front end sides of the bending die 2 and the linear die 3 to their back end sides in a state of pinching the dies 2 and 3 in the die closing direction.

With respect to the bending die 2 and the linear die 3 after the each roller 40, 50 passing, a front end side of the die 2 is moved in a direction away from the die 3, and the dies 2 and 3 are in a state of being opened.

At this time, because the front end of the workpiece W is held by the forming face 2*a* of the bending die 2, the workpiece W is away from the linear die 3 in a state of being stuck to the face 2*a*, and is bent like an arc along the face 2*a*.

When the slide unit 20 shown in FIG. 1 is moved backward to a predetermined position, the unit 20 is detected by a position detection sensor (not shown) at the back portion of the table 10, and the rotation shaft 61*a* of the drive motor 61 is reversely rotated, based on a detection signal from the sensor at the back portion. According to this, the slide unit 20 is moved forward; when the unit 20 is moved to the front ends of the bending die 2 and the linear die 3, the unit 20 is detected by a position detection sensor (not shown) at the front portion of the table 10, the rotation of the rotation shaft 61*a* stops, based on a detection signal from the sensor at the front portion, and the unit 20 stops.

When the each roller 40, 50 is stopped at the front ends of the bending die 2 and the linear die 3, the dies 2 and 3 are in a state of their front end sides being closed and their back end sides being opened. In this state a worker removes the workpiece W after bending from the forming face 2*a* of the bending die 2. According to this, a proximity sensor (not shown) provided in the hold member 4 does not detect the workpiece W, as shown in FIG. 4, the rod 74*a* of the hydraulic cylinder 74 is retracted, a distance between the each roller 40, 50 is broadened, and a pushing force acted on the bending die 2 and the linear die 3 from the die closing direction is reduced.

[Action and Effect of Bending Apparatus and Bending Method]

According to the bending apparatus 1 and bending method of the embodiment, as shown in FIG. 5B, it is possible to uniformly act a bending stress on the workpiece W; therefore, it is possible to improve a working accuracy.

Furthermore, by preparing in advance the bending die 2 and the linear die 3 whose curvature and forming-face form are different, and changing the dies 2 and 3 associating a form of the workpiece W therewith, it is possible to speedily adapt various forms of bending.

Furthermore, according to the bending apparatus 1 and bending method of the embodiment, because the each roller, 40, 50 is moved relative to the bending die 2 and the linear die 3, and the dies 2 and 3 are positioned on the work face 11*a*, it is sufficient if a space is ensured on the face 11*a* where the dies 2 and 3 can be placed.

That is, it is possible to perform similar bending with a half distance in comparison with a conventional configuration of moving the bending die 2 and the linear die 3 relative to the each roller 40, 50.

Accordingly, it is possible to configure the bending apparatus 1 compact and to make a work space, which is required for bending, small.

Furthermore, according to the bending apparatus 1 and bending method of the embodiment, because bending is performed in a state of the bending die 2 and the linear die 3 being positioned on the work face 11*a*, it is not necessary for a worker to handle the dies 2 and 3 for every one bending.

Accordingly, even in continuously performing bending, and in using a large size of the bending die 2 and the linear die 3, it is possible to improve the work efficiency of the bending.

Another Embodiment

As described above, although the embodiment of the present invention has been described as an example, various modifications and changes can be applied to the embodiment as far as they do not deviate from the spirit and scope of the invention defined in the scope of attached claims.

Figure 6:
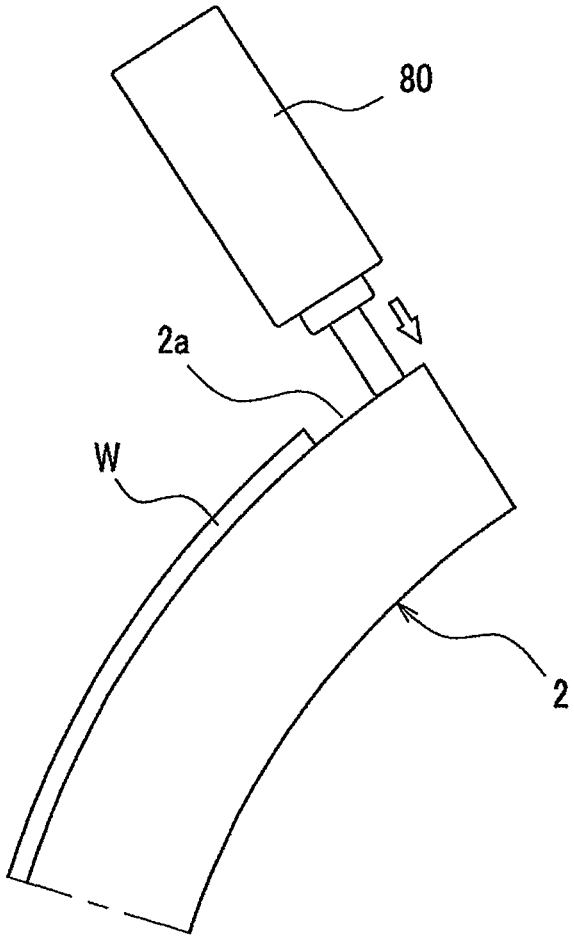
FIG. 6 is a plan view showing an energizing device provided in a bending apparatus of another embodiment of the invention.

For example, as shown in FIG. 6, an energizing device 80 may be provided that extrudes the bending die 2 in a die opening direction. In addition, as the energizing device 80, one such as an air cylinder can be used other than a hydraulic cylinder shown in FIG. 6.

According to this configuration, the forming face 2*a* of the bending die 2 is extruded in a die opening direction, and thereby, the face 2*a* is moved in a direction (die opening direction) away from the workpiece W after bending. According to this, because an end of the workpiece W stuck to the forming face 2*a* of the bending die 2 can be peeled off from the face 2*a*, it is possible to easily remove the workpiece W from the die 2 and to improve the work efficiency of the bending.

The invention claimed is:

1. A bending apparatus for bending an object to be worked, using a bending die formed in accordance with a bent form of the object, and a linear die linearly extended, the apparatus comprising:

a table having a work face where the bending die and the linear die are placed;

a pair of rollers configured to move along the work face, wherein each of the rollers is configured to move from a first end side of the bending die and the linear die to a second end side thereof in a state of pinching the bending die and the linear die in a die closing direction towards the object, wherein the pinching deforms the object; and an energizing device configured to push out a forming face of the bending die in a die opening direction away from the object after the object is deformed, wherein the energizing device pushes out the forming face of the bending die after the pair of rollers is returned to the first end side of the bending die and the linear die.

2. A bending method for bending an object to be worked, using a bending die formed in accordance with a bent form of the object and a linear die linearly extended, the method comprising the steps of:

attaching the object to a forming face of the linear die, and holding one end of the object to one end of a forming face of the bending die;

moving a pair of rollers from a first end side of the bending die and the linear die to a second end side thereof in a state of pinching the bending die and the linear die in a die closing direction towards the object by each of the rollers, and deforming the object along the forming face of the bending die; and pushing out the forming face of the bending die in a die opening direction away from the object by an energizing device after deforming the object, wherein the energizing device pushes out the forming face of the bending die after the pair of rollers is returned to the first end side of the bending die and the linear die.

* * * * *